US007166255B2

(12) United States Patent
Takeguchi et al.

(10) Patent No.: US 7,166,255 B2
(45) Date of Patent: Jan. 23, 2007

(54) METHOD FOR MANUFACTURING A CAM

(75) Inventors: Shunsuke Takeguchi, Tochigi (JP); Hiroyuki Takamura, Tochigi (JP)

(73) Assignee: Nippon Piston Ring Co., Ltd., Saitama (JP)

( * ) Notice: Subject to any disclaimer, the term of this patent is extended or adjusted under 35 U.S.C. 154(b) by 0 days.

(21) Appl. No.: 11/078,262

(22) Filed: Mar. 11, 2005

(65) Prior Publication Data

US 2005/0207932 A1 Sep. 22, 2005

(30) Foreign Application Priority Data

Mar. 16, 2004 (JP) ..... P2004-074719

(51) Int. Cl.
*B22F 3/16* (2006.01)

(52) U.S. Cl. ..... 419/26; 419/38

(58) Field of Classification Search ..... 419/28, 419/29

See application file for complete search history.

(56) References Cited

U.S. PATENT DOCUMENTS 3,940,269 A * 2/1976 Bergstrom ..... 419/41
4,388,114 A * 6/1983 Suganuma et al. ..... 75/243
6,338,747 B1 * 1/2002 Kosco ..... 75/243

FOREIGN PATENT DOCUMENTS

JP 08-295904 11/1996

* cited by examiner

*Primary Examiner*—Roy King
*Assistant Examiner*—Kathleen McNelis
(74) *Attorney, Agent, or Firm*—Ladas & Parry LLP

(57) ABSTRACT

The temporary compacting of the powder for use in sintering is carried out, the temporary sintering is carried out, the main compacting is carried out, the main sintering is carried out, and the thickness of the radius direction of the base part of the cam before the heat-treatment is set to 3.0 mm or more.

1 Claim, 6 Drawing Sheets

Dimensional change on each process in the thickness at 2.0 mm

METHOD FOR MANUFACTURING A CAM

TECHNICAL FIELD

The present invention relates to method for manufacturing a cam for use in an assembled camshaft. Furthermore, it is related to the method for manufacturing a cam, which is presenting the final target form after heat-treatment, and it is not necessary to process the circumference of a cam when heat-treatment was finished.

BACKGROUND ART

For example, the cam shaft used in internal-combustion engines, such as engine of a car, tends to be changed from the conventional cast iron camshaft to assembled camshafts for the purpose of getting the lighter weight.

Furthermore the method for manufacturing a cam by sintering to which post-processing (grinding etc.) of a cam circumference side (cam profile) become unnecessary is also proposed. The method presents to cut down the manufacturing cost of the assembled camshaft after assembling a cam and a shaft.

For example, the Japanese patent reference (JP H08-295904: reference1) is related to the manufacturing method of a cam which is used by process flow s (1)–(3) as follows, (1): compacting of the powder for use in sintering, (2): sintering after (1), (3): thermal refining after (2). The reference mentions that correcting for reverse of direction of distortion which is produced by (3) is processed after (2) and changing the target circumference form of a cam utilizing distortion occurred by thermal refining is achieved.

Moreover, the European patent reference (EP 0718473: reference2) is related to the manufacturing method of a cam, which manufactures the cam shaft for internal-combustion engines, by the processes of sintering and sintering forging. The reference mentions that manufacturing and correcting a cam provisionally by taking into consideration a form error and a size are processed and post-processing is not necessary by making it change by thermal deformation produced in the cases, such as sintering.

However, the manufacturing method of a cam mentioned in the reference1 needs at least 4 processes, which are "compacting", "sintering", "correction", and "thermal refining". Comparing with the conventional the manufacturing method of a cam, the conventional one needs 4 processes "compacting", "sintering", "thermal refining", and "post-process (grinding)" and both manufacturing methods have to need the same number of processes.

The manufacturing method of a cam mentioned in the reference1 is not able to reduce cost of manufacturing substantially.

The manufacturing method of a cam mentioned in the reference2 needs to take into consideration of thermal deformation such as "sintering", "thermal refining", etc. The methods have problems that a design and manufacture of the metallic mold for molding or the metallic mold for correction and the taking into consideration of thermal deformation are difficult.

DISCLOSURE OF THE INVENTION

Method for manufacturing a cam by powder metallurgy of the present invention may adopt the following aspects capable of obtaining at least of the advantages.

The present invention presents some advantages in order to improve the conventional manufacturing methods, that is, presents manufacturing method, which are not to correct the circumference of a cam after heat-treatment and offer a simple method comparing with conventional manufacturing methods.

The inventor of the present invention has recognized the following matter first and presents the present invention by improving to the matter.

That is, it became first problem that the form of a cam changes by thermal deformation such as sintering, thermal refining, when manufacturing a cam by sintering. The inventor of the present invention has recognized that the part, which the thermal deformation tends to produce, is a base part of a cam.

A base part of a cam has a hole, which a shaft punctures through. The base part of a cam tends to take thermal deformation comparing with a nose part of a cam because the thickness in radius direction of base part of a cam is thinner than a nose part of a cam.

According to one aspect of the present invention, method for manufacturing a cam by powder metallurgy comprising: temporary compacting, temporary sintering, main compacting, main sintering, making the thickness thicker which the thickness in the radius direction of base part of a cam makes more than 3.0 mm and heat-treatment after the thickness thicker. According to another aspect of the present invention, the nose part of cam is corrected by the metallic mold, which is used by main compacting.

The present invention presents method for manufacturing a cam by powder metallurgy comprising: temporary compacting, temporary sintering, main compacting, main sintering (so-called ] 2P2S (compacting twice and sintering twice)), making the thickness thicker which the thickness in the radius direction of base part of a cam makes more than 3.0 mm and heat-treatment (thermal refining) after the thickness thicker. Hence, thermal deformation on a base part of a cam is reduced and/or uniformized. For that reason, present invention presents that (1) the process of correcting on a base part of a cam is not necessary before heat-treatment and (2) the post-processing such as grinding is not necessary. present invention may manufacture a cam without above-mentioned (1) and/or (2) process.

The present invention presents method for manufacturing a cam by powder metallurgy comprising: the nose part of cam is corrected specially by the metallic mold, which is used by main compacting which has high precision. The correcting is processed so as to the different form from the final target form. The present invention presents method for manufacturing a cam which is not necessary to have a correcting process mentioned in reference 1.

A nose part of a cam is important part because it makes valve open. Forming of a nose part of a cam is more precise than that of a base part of a cam.

A nose part of a cam is under heavy load and needs stronger because its mass density is risen up.

A nose part of a cam tends to be longer and/or larger according to person skilled in the art. However, a nose part of a cam which is important part is corrected into different form from the final target form in the present invention. The different form is scaling down. Hence, the correction provides the strength on a nose part of a cam with mass density risen up. The nose part of a cam is arranged into the final target form by thermal deformation in heat-treatment, etc.

EXPLANATIONS OF REFERENCE MARKSNUMERALS

20: cam; 21: base part of cam; 22: nose part of cam; 23: hole.

BEST MODE FOR CARRYING OUT THE INVENTION

Next, a preferred embodiment of the present invention will be described by the use of an example.

Figure 1:
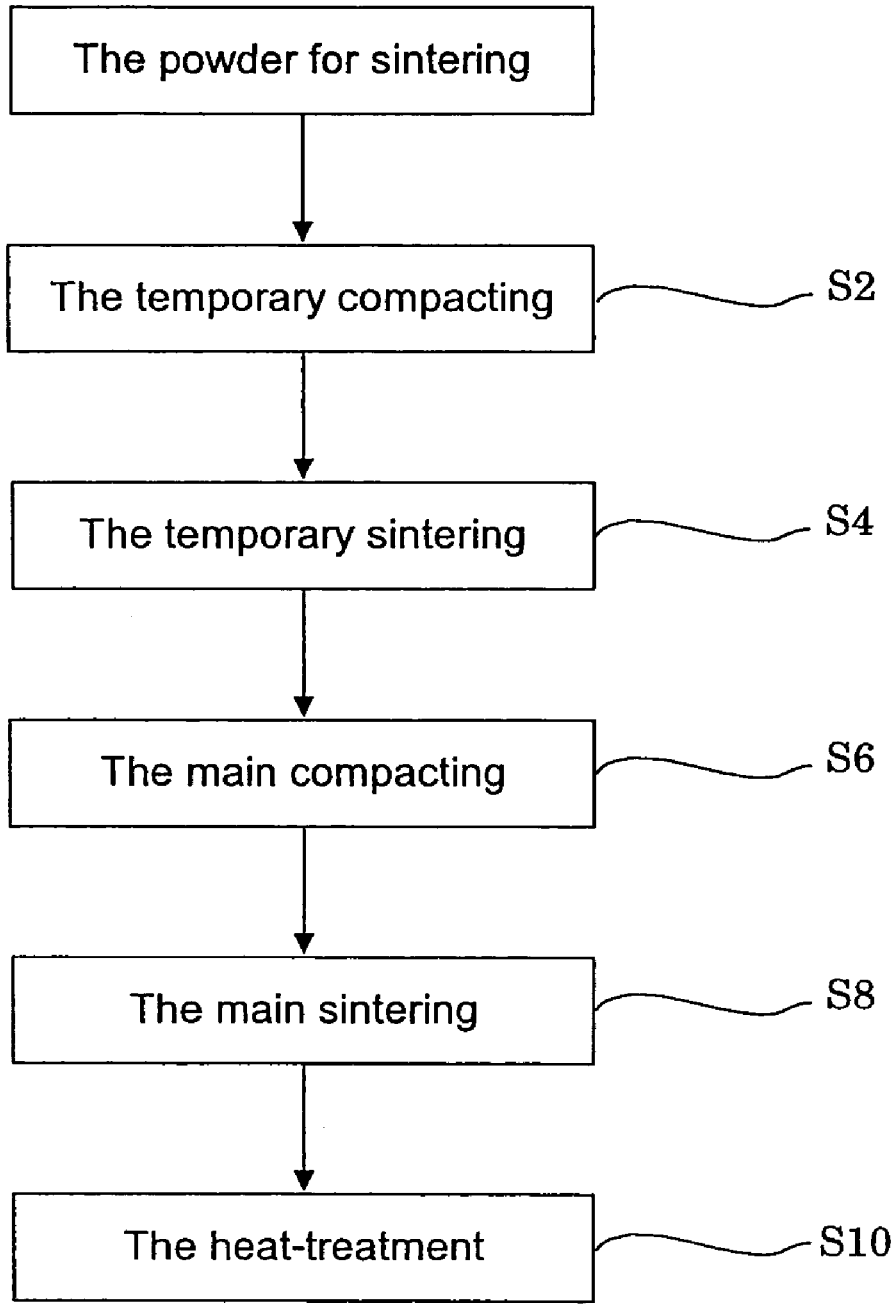
FIG. 1 is a flowchart showing processes of manufacturing method of a cam in one aspect of the present invention.

FIG. 1 is a flowchart showing processes of manufacturing method of a cam in one aspect of the present invention.

Figure 2:
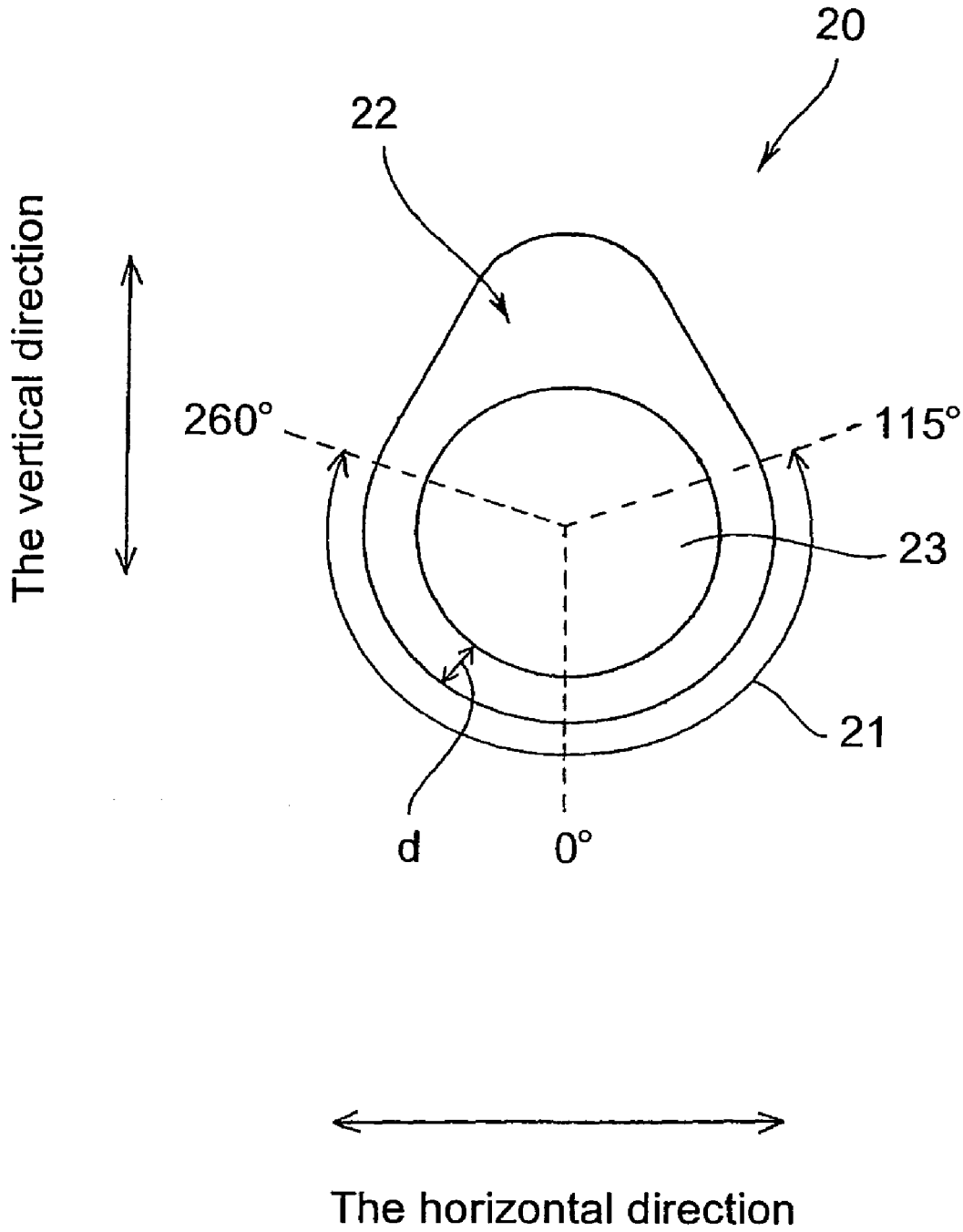
FIG. 2 is a elevational view of a cam manufactured by manufacturing method of a cam in one aspect of the present invention.

FIG. 2 is a elevational view of a cam manufactured by manufacturing method of a cam in one aspect of the present invention.

FIG. 2 shows the explanation in each part of a cam manufactured by manufacturing method of a cam in one aspect of the present invention.

As shown in the figure, a cam 20 is consisted of a base part 21 and a nose part 22. A base part 21 may not rift up because circumference form is almost in a circular pattern. A nose part 22 is other than a base part 21. A nose part 22 may rift up because circumference form is not in a circular pattern.

A cam 20 has a hole 23 which shaft assembled with a cam 20 punctures through. In the present claims and specification, "the thickness in the radius direction" is definited as the length from the circumference of the hole 23 to circumference of the base part 21 as shown symbol "d" in FIG. 2.

A cam 20 is manufactured as shown in FIG. 1, that is, manufacturing method comprising: temporary compacting (S2), temporary sintering (S4), main compacting (S6), main sintering (S8), making the thickness thicker which the thickness in the radius direction of base part of a cam makes more than 3.0 mm and heat-treatment (S10) after the thickness thicker. Making the thickness thicker which the thickness in the radius direction of base part of a cam makes more than 3.0 mm is originated as the thickness in the radius direction" is kept more than 3.0 mm.

Providing the thickness in the radius direction is fewer than 3.0 mm, strain on heat-treatment is large. On the base part 21, the strain causes thermal deformation to inside direction in the horizontal direction and to outside direction in the vertical direction, as shown in FIG. 2. The vertical direction is definited as the direction that connects the cam head of nose part 22 and the center of the hole 23 with a dotted line as shown in FIG. 2. The horizontal direction is definited in a direction perpendicular to the vertical direction as shown in FIG. 2. The base part of a cam may change into an ellipse as a whole as a result in thermal deformation. Since the present invention is setting the thickness of the radius direction of the base part of a cam to 3.0 mm or more, the strain is yielded little. However, in the method of the present invention, after heat-treatment (S10) the thickness of the radius direction of the base part can be made less than 3.0 mm after heat-treatment. For example, it may be originated from process adjusted by inner grinding of the hole 23 for shafts. The thickness of the radius direction of the base part at final target form of cam 20 may be made less than 3.0 mm.

Each processes of the present invention are explained in detail below.

[Powder for Use in Sintering]

The powder for use in sintering used in order to manufacture a cam 20 in the method of the present invention may not be limited and can use any powder for use in sintering that person in the skill of art uses.

[Temporary Compacting]

The powder for use in sintering was compressed and molded on temporary compacting (S2). Cam 20 was formed as a rough cam form used by a metal mold, which is used in temporary compacting.

In the temporary compacting, it is desirable to put about 6.5–7.0 ton/cm$^2$ pressures.

At the stage after temporary compacting, the thickness of the radius direction of the base part is not limited especially. However, it is desirable to take thermal deformation into consideration by temporary sintering (S4) and the main sintering (S8) and to count backward so that the thickness of the radius direction of the base part of the cam in the before the heat-treatment (S10) processed at the end process may be set 3.0 mm or more, even if the thermal deformation arises.

[Temporary Sintering]

The temporary sintering (S4) in the method of the present invention means to sinters preparatorily the cam after said temporary compacting (S2).

In the temporary sintering, it is desirable to sinter at 700–900 degrees and about 0.5–2 hours are desirable to sinter, although they may depend on sizes of the cam manufactured.

[Main Compacting]

The main compacting (S6) in the method of the present invention is the process that is compressed again by metal mold used by the main compacting which is different from said metal mold which is used in temporary compacting.

In the main compacting in the present invention, it is desirable to put the pressure, which is about 9.0–12.0 ton/cm$^2$ into the nose part 22 of a cam 20. The nose part 22 of a cam 20 should be risen mass density up because of strength of nose part 22 of a cam 20.

Moreover, it is desirable to correct to different form from the final target form by the metal molding used in the main compacting (S6) only to the nose part 22 of cam 20.

The correcting to said different form is formed in the direction of scaling down of nose part 22 comparing with the final target form. The nose part 22 tends to expand by the main sintering (S8) and heat-treatment (S10). The direction is opposite direction against the thermal deformation's direction, which is originated in the extension of nose part 22 of a cam 20 from the main sintering (S8) and heat-treatment (S10).

[Main Sintering]

The main sintering (S8) in the method of the present invention sinters the cam after the main compacting (S6) again.

In the main sintering, it is desirable to sinter at 1100–1200 degrees and about 0.5–2 hours are desirable to sinter, although they may depend on sizes of the cam manufactured.

Providing the cam is sintered above 1200 degrees in the main sintering, the thermal deformation may be too large and small blistering may be occurred.

In the method of the present invention, the thickness of the radius direction of the base part 21 of the cam 20 after the main sintering is 3.0 mm or more. Even if the heat-treatment (S10) mentioned later is performed, the base part 21 of a cam 20 does not have thermal deformation greatly and it is not necessary to carry out post-processing of grinding etc. Moreover, it is not necessary to correct after the main sintering.

[The Heat-treatment]

The heat-treatment (S10) in the method of the present invention means the process to carry out quench-temper treatment (thermal refining) after the main sintering (S8).

The heat-treatment (S10) may be consisted of the processes of heating at 850–950 degrees, oil quenching at 50–120 degrees after heating, heating at 100–250 degrees after the oil quenching and air cooling.

In the method of the present invention, the cam after performing said heat-treatment is not necessary to be processed with post-processing of grinding etc. The cam as it is after said heat-treatment can be manufactured for the cam shaft.

Figure 3:
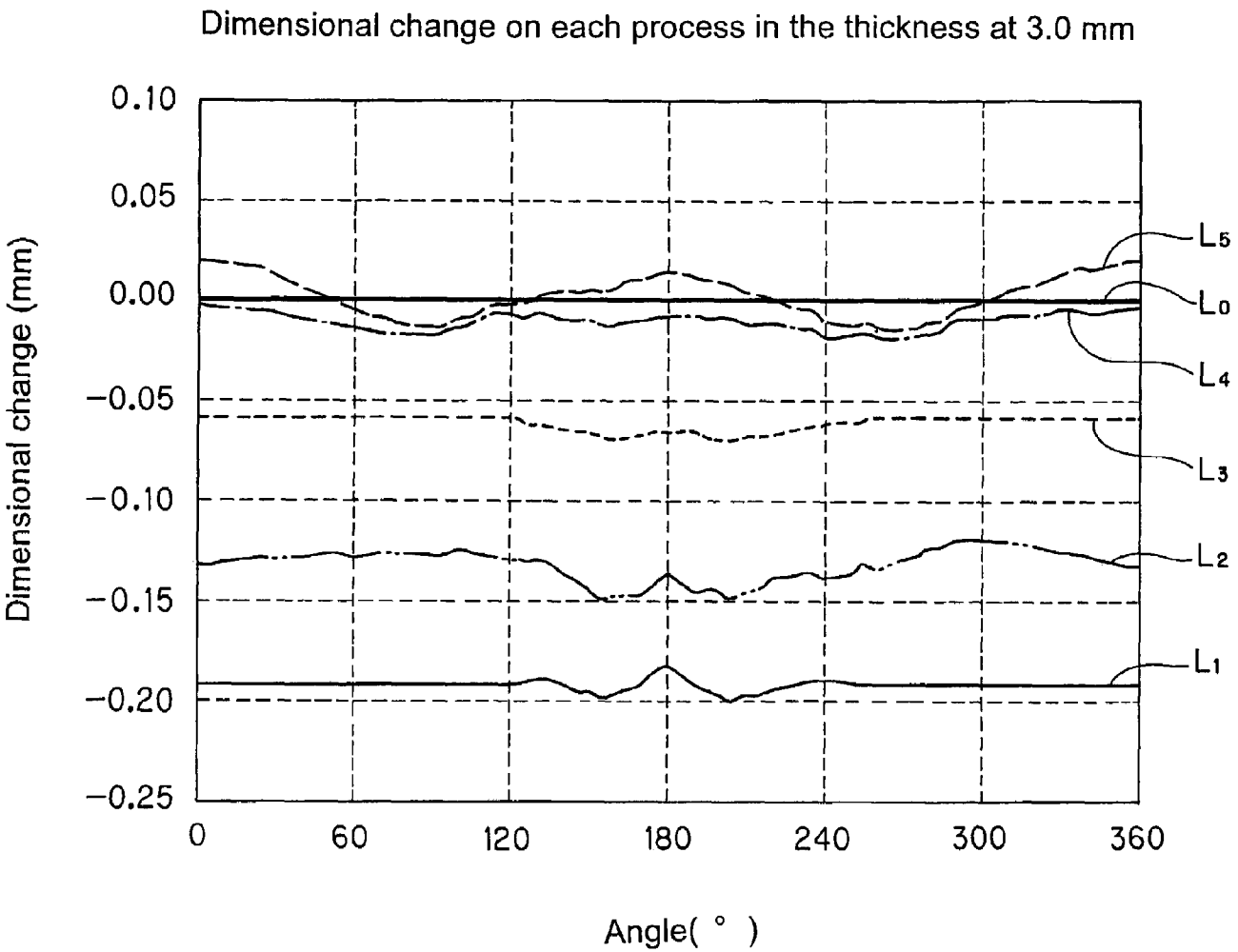
FIG. 3 is an explanatory view showing dimensional change in each process in one aspect of the present invention which is the thickness in the radius direction of base part of a cam is more than 3.0 mm before heat-treatment.
Figure 4:
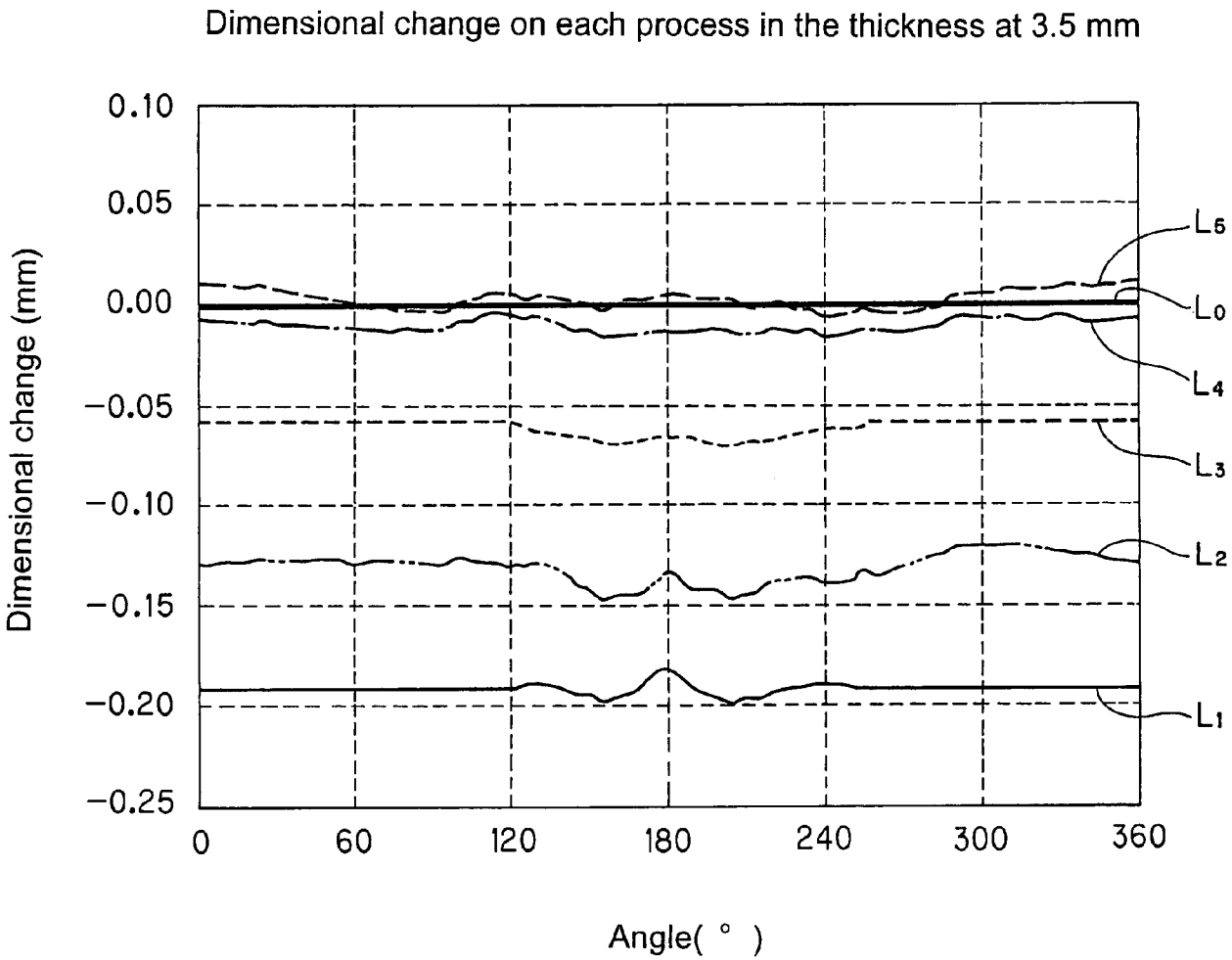
FIG. 4 is an explanatory view showing dimensional change in each process in one aspect of the present invention which is the thickness in the radius direction of base part of a cam is more than 3.5 mm before heat-treatment.

Such each process in the method of the present invention is indicated still more concretely using FIG. 3 and FIG. 4.

FIG. 3 and FIG. 4 are figures showing the cam form after each above-mentioned process which constitutes the method of the present invention. FIG. 3 shows the case where the thickness of the radius direction of the base part of the cam before said heat-treatment is set to 3.0 mm. FIG. 4 shows the case where the thickness of the radius direction of the base part of the cam before the heat-treatment is set to 3.5 mm.

The value of the vertical axis of the graph of FIG. 3, FIG. 4, FIG. 5 and FIG. 6 means dimensional change corresponding to each process. The line L0 means the line of 0.00 in the vertical axis of the graph of FIG. 3 and FIG. 4. The line L0 is equivalent to the final target form of cam. The line L1 is equivalent to the form of the cam after the temporary compacting. The line L2 is equivalent to the form of the cam after the temporary sintering. The line L3 is equivalent to the form of the cam after the compacting.

The line L4 is equivalent to the form of the cam after the main sintering. The line L5 is equivalent to the form of the cam after the heat-treatment.

The value of the horizontal axis of the graph of FIG. 3, FIG. 4, FIG. 5 and FIG. 6 means angle drawing a sharp contrast between the base part and the nose part on the cam. The angle in the range of 0–115 degrees and 260–360 degrees is equivalent to the base part 21 of a cam 20. The angle in the range of 115–260 degrees is equivalent to the angle of action of cam 20, that is, the nose part 22 of a cam 20.

The base part 21 of a cam 20 is formed into the almost same form as the final target after the temporary compacting at first in the present invention as shown in FIG. 3 and FIG. 4 (the line L1 and the line L0 are almost linear).

The nose part 22 of a cam 20 is temporary compressed and temporary molded so that it may be formed into the different form from the final target form.

The cam form after the temporary sintering performed to the next is be transformed in both the base part 21 and the nose part 22 of a cam 20 as shown at line L2. On the cam after the main compacting performed to the next, the base part 21 is formed into the almost same form as the final target form and the nose part 22 of a cam 20 is temporary compressed and temporary molded so that it may be formed into the different form from the final target form as shown at line L3.

In the present invention, a special correction is not necessary and the amount of change shape can also be calculated since the thickness of the radius direction is 3.0 mm or more. And, the correction is only performed to nose part 22 so that it may be formed into the different form from the final target form.

Furthermore, the change shape on the nose part 22 is transformed so that it may be convex upward compared with a base part by the temporary sintering as shown at line L2 and it may be convex downward compared with a base part by the compacting as shown at line L3. The result may be originated from the mass density up because the nose part 22 is compressed so as to be corrected into the scale down. The cam form is transformed after the main compacting changing as shown at line L4. The final target form is as shown at line L5. Comparing with line L0 and line L5 which shows the form of the cam manufactured by the method of the present invention, it is an about 0.01–0.02 mm size error in the whole range of angle, which is a size error quite lower than 0.05 mm defined as the maximum size error among person in the skill of art. The size error is permissible on enforcement.

The manufacturing method why the thickness of the radius direction of the base part is formed 3.0 mm or less shows in the method hereinafter prescribed. The cam is manufactured by the method of the present invention at first. The manufactured cam is 3.0 mm or more. The thickness of the radius direction of the base part at the final sized may be processed on the basis of desired thickness.

Figure 5:
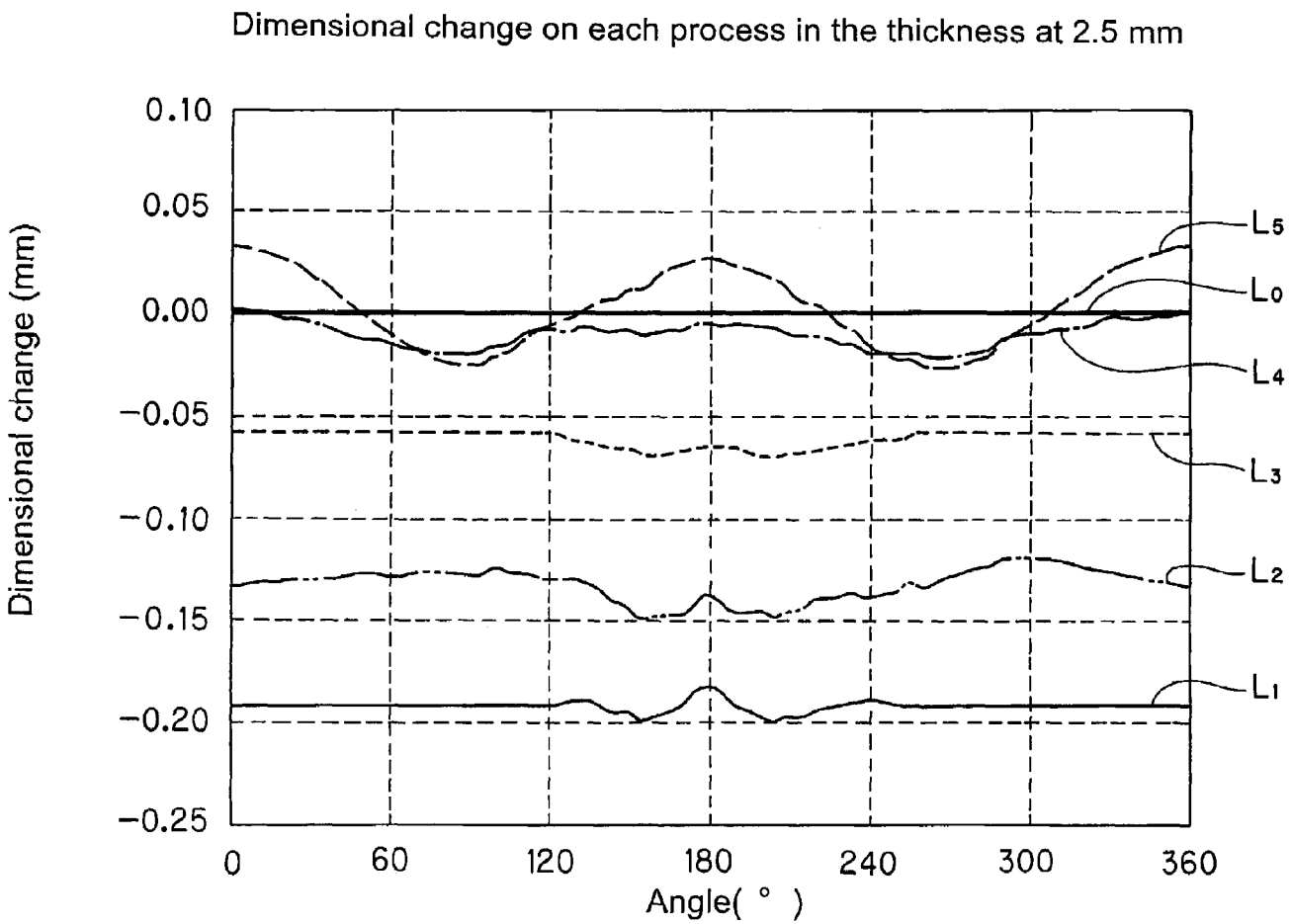
FIG. 5 RELATED ART
FIG. 5 is an explanatory view showing dimensional change in each process in one aspect of the present invention which is the thickness in the radius direction of base part of a cam is more than 2.5 mm before heat-treatment.
Figure 6:
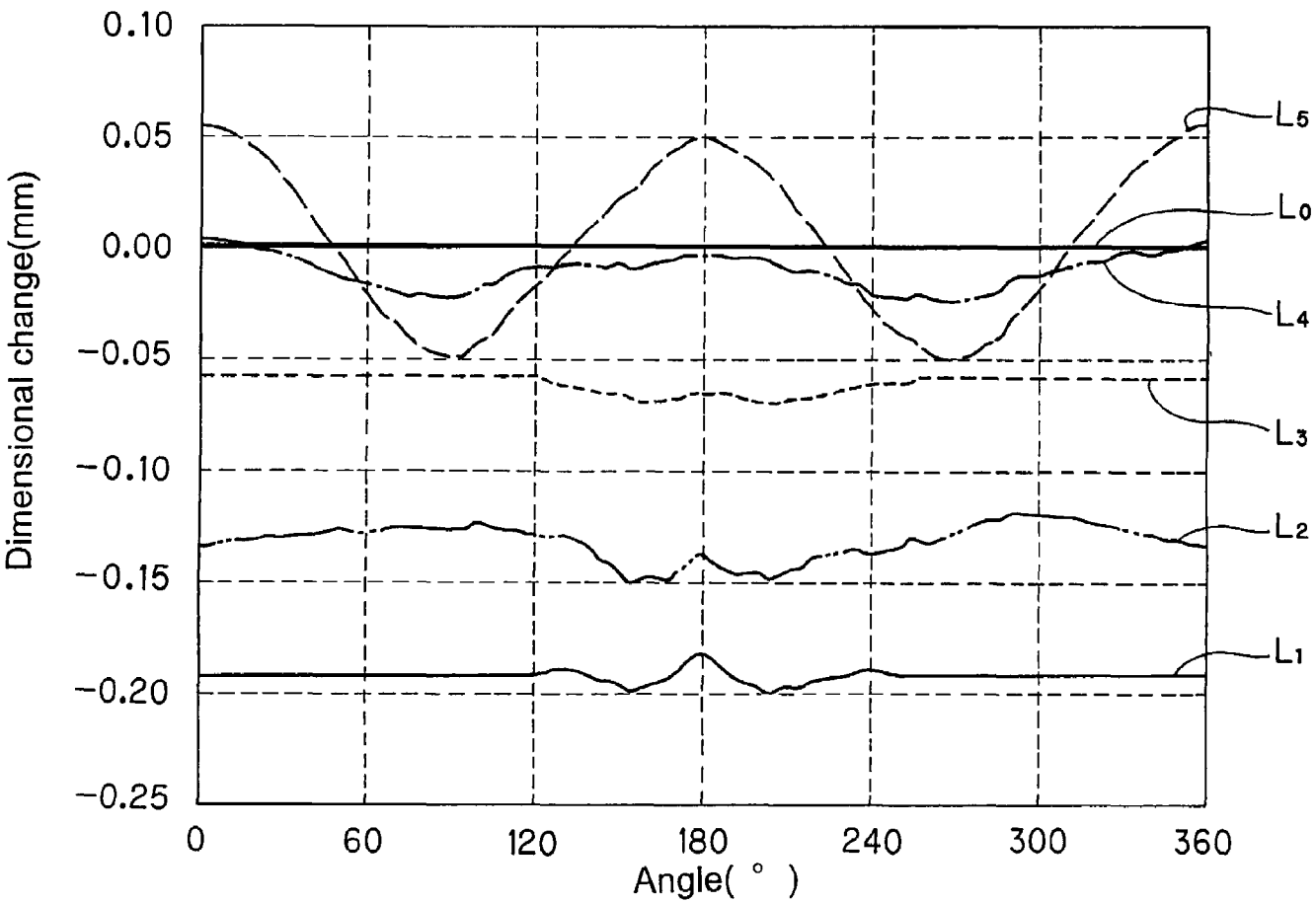
FIG. 6 RELATED ART
FIG. 6 is an explanatory view showing dimensional change in each process in one aspect of the present invention which is the thickness in the radius direction of base part of a cam is more than 2.0 mm before heat-treatment.

In order to compare with the method of the present invention, the case where the thickness of the radius direction of the base part of the cam before the heat-treatment is set to 2.5 mm is shown in FIG. 5, and the case where the thickness of the radius direction of the base part of the cam before the heat-treatment is set to 2.0 mm is shown in FIG. 6. In addition, the view of the figure is the same as FIGS. 3 and 4, which explain the method of the above-mentioned invention.

Providing the thickness of the radius direction of the base part is formed 3.0 mm or less as shown in FIG. 5 and FIG. 6, it is an about 0.03–0.05 mm size error at the final target form, which approaches 0.05 mm defined as the maximum size error among person in the skill of art. Furthermore, the thermal deformation in the case of heat-treatment is large and the base part of a cam may be ellipse form in the form of the vertical direction longer. Consequently, the base part of a cam may keep in ellipse even after assembling with a cam shaft.

Since the thickness of the radius direction of the base part of the cam before the heat-treatment is set to 3.0 mm or more according to the method of the present invention, a size error can be made low to about 0.01–0.02 mm, a design and manufacture of the object for compacting and the metallic mold for correction become simple as compared with the conventional method and control of a size error is easy for the present invention.

In the above, the preferred embodiment of the present invention is described by means of the example. However, the present invention is not limited to the example, and it goes without saying that the present invention can be implemented by adopting various forms within the sprit and scope of the present invention.

The invention claimed is:

1. A method for manufacturing a cam having a base part and a nose part, comprising the steps of:

(i) temporarily compacting powder for use in sintering to prepare a temporarily compacted body;

(ii) temporarily sintering the temporarily compacted body to prepare a temporarily sintered body;

(iii) main compacting the temporarily sintered body to prepare a main compacted body;

(iv) main sintering the main compacted body; and (v) heat-treating the main compacted body, thereby manufacturing the cam, wherein in a thickness in a radius direction of the base part of the cam is kept more than 3.0 mm in the steps (i) to (iv), and the nose part of the cam is formed into a different form from a final target form for the cam in the steps (i) and (iii), and the base part of the cam is formed the same form as the final target form in the steps (i) and (iii).

* * * * *